US005139921A

United States Patent [19]

Takagi et al.

[11] Patent Number: 5,139,921

[45] Date of Patent: Aug. 18, 1992

[54] PROCESS FOR FORMING SUPER HIGH CONTRAST NEGATIVE IMAGES

[75] Inventors: Yoshihiro Takagi; Hisashi Okada; Morio Yagihara, all of Kanagawa, Japan

[73] Assignee: Fuji Photo Film Co., Ltd., Kanagawa, Japan

[21] Appl. No.: 653,480

[22] Filed: Feb. 12, 1991

Related U.S. Application Data

[63] Continuation of Ser. No. 295,671, Jan. 11, 1989, abandoned.

[30] Foreign Application Priority Data

Jan. 11, 1988 [JP] Japan ..... 63-3445
Jan. 11, 1988 [JP] Japan ..... 63-3446

[51] Int. Cl.[5] ..... G03C 5/26

[52] U.S. Cl. ..... 430/264; 430/438; 430/464; 430/487; 430/566

[58] Field of Search ..... 430/264, 267, 373, 374, 430/383, 438, 487, 464, 570, 566

[56] References Cited

U.S. PATENT DOCUMENTS

| | | | |
|---|---|---|---|
| 4,221,857 | 9/1980 | Okutsu et al. | 430/264 |
| 4,272,606 | 6/1981 | Mifune et al. | 430/264 |
| 4,699,873 | 10/1987 | Takahashi et al. | 430/603 |
| 4,761,362 | 8/1988 | Sasaoka et al. | 430/265 |
| 4,772,546 | 9/1988 | Deguchi et al. | 430/603 |
| 4,803,149 | 2/1989 | Takahashi et al. | 430/264 |
| 4,818,659 | 4/1989 | Takahashi et al. | 430/265 |
| 4,839,258 | 6/1989 | Katoh | 430/264 |
| 4,865,947 | 9/1989 | Kuwabara et al. | 430/264 |

FOREIGN PATENT DOCUMENTS 2206700 1/1989 United Kingdom .

*Primary Examiner*—Hoa Van Le
*Attorney, Agent, or Firm*—Sughrue, Mion, Zinn, Macpeak & Seas

[57] ABSTRACT

A process of forming super high contrast negative photographic materials in a developer having a pH of from 9.6 to 11.0 wherein the photographic material contains a hydrazine compound and a nucleation accelerator.

The nucleation accelerator is represented by formula (Ia):

$$Y[(A_1)_pA_2-B]_m \qquad \text{(Ia)}$$

wherein Y represents a group adsorbing onto silver halide; $A_1$ represents a divalent linkage group composed of an atom or an atomic group selected from hydrogen, carbon, nitrogen, oxygen, and sulfur and selected from with a straight chain or branched alkylene group wherein $R_1$, $R_2$, $R_3$, $R_4$, $R_5$, $R_6$, $R_7$, $R_8$, $R_9$ and $R_{10}$ each represents hydrogen, a substituted or unsubstituted alkyl group, a substituted or unsubstituted aryl group, a substituted or unsubstituted alkenyl group or a substituted or unsubstituted aralkyl group; $A_2$ represents a divalent linkage group selected from a straight chain or branched alkylene group, a straight chain or branched alkenylene group, a straight chain or branched aralkylene group or a straight chain or branched arylene group; B represents a substituted or unsubstituted amino group, an ammonium group, or a nitrogen-containing heterocyclic ring; m represents the integer 1, 2, or 3; and p represents 0 or the integer 1.

11 Claims, No Drawings

PROCESS FOR FORMING SUPER HIGH CONTRAST NEGATIVE IMAGES

This is a continuation of application Ser. No. 07.295,671 filed Jan. 11, 1989 now abandoned.

FIELD OF THE INVENTION

This invention relates to a silver halide photographic material and a process for forming super high contrast negative images. More particularly, the invention relates to a silver halide photographic material for use in a photomechanical process.

BACKGROUND OF THE INVENTION

In the field of graphic arts, an image forming system having super high contrast (in particular, a gamma ($\overline{G}$) of at least 10) is required for improving the reproduction of continuous tone by dot images or the reproduction of line images.

For this purpose, a specific developer called "lith developer" has hitherto been used. The lith developer consists of hydroquinone as the developing agent and also contains a sulfite as a preservative in the form of an addition product with formaldehyde, whereby the concentration of free sulfite ions is reduced as low as possible (typically below 0.1 mol/liter). Accordingly, the lith developer is susceptible to air-oxidation and thus cannot be stored for over 3 days.

Methods of obtaining high contrast and high sensitivity photographic characteristics using a stable developer and hydrazine derivatives are described in U.S. Pat. Nos. 4,224,401, 4,168,977, 4,166,742, 4,311,781, 4,272,606, 4,211,857, 4,243,739, etc. Furthermore since sulfite can be added at a high concentration, the stability of the developer to air oxidation is greatly improved as compared to the lith developer.

However, for forming super high contrast images using a hydrazine derivative, the pH of the developer must be at least 11.0. In such circumstances, the developing agent is liable to be oxidized, the pH is liable to deviate by absorbing $CO_2$ from the air and stable photographic properties are thus not obtained. Accordingly, a process of obtaining super high contrast images in a developer having a high sulfite ion concentration at a pH below 11.0 has been desired.

A means for increasing the activity of hydrazine has been keenly desired and in this regard, phosphonium salt compounds in JP-A-61-167939 (the term "JP-A" as used herein mean as "unexamined published Japanese patent application"), disulfide compounds in JP-A-61-198147, and amine series compounds in JP-A-60-140340 are disclosed as contrast enhancing agents. However, even by using these compounds, it is difficult to further enhance contrast at a pH below 11.

On the other hand, a low-speed, light-sensitive material for safelight use employing a hydrazine compound, and containing a water-soluble rhodium salt, is disclosed in JP-A-60-83038 and 60-162246. However, in this case, the addition of a sufficient amount of rhodium salt to increase the sensitivity obstructs the increase of contrast by the hydrazine compound, whereby the desired sufficiently high contrast images are not obtained.

SUMMARY OF THE INVENTION

An object of this invention, therefore, is to provide a process of forming super high contrast images using a developer having a pH of from 9.6 to 11.0 in a system containing a hydrazine compound.

Another object of this invention is to provide a process of forming super high contrast images with stable photographic performance using a stable developer.

It has now been discovered that the aforesaid objectives can be attained by the process of the present invention as set forth below.

That is, according to the present invention, a process is provided for forming super high contrast negative images, which comprises the steps of: processing a super high contrast negative-type silver halide photographic material comprising a support having formed thereon at least one layer, one of which must be a silver halide emulsion layer, containing therein or in another hydrophilic colloid layer at least one hydrazine derivative and at least one nucleation accelerator represented by formula (Ia) or (Ib) with a developer having a pH of from 9.6 to 11.0;

$$Y\text{-}[(A_1)_p A_2\text{—}B]_m \quad \text{(Ia)}$$

$$M_1S(\text{-}X)_n A_3\text{—}B \quad \text{(Ib)}$$

wherein Y represents a group adsorbing onto silver halide; $A_1$ represents a divalent linkage group composed of an atom or an atomic group selected from hydrogen, carbon, nitrogen, oxygen, and sulfur; $A_2$ represents a divalent linkage; $A_3$ represents a divalent linkage group composed of an atom or an atomic group selected from carbon, nitrogen, oxygen, and sulfur; B represents an amino group which may be substituted, an ammonium group, or a nitrogen-containing heterocyclic ring; X represents a divalent heterocyclic ring containing a nitrogen atom, oxygen atom, selenium atom, or sulfur atom; $M_1$ represents a hydrogen atom, an alkali metal, an alkaline earth metal, a quaternary ammonium salt, a quaternary phosphonium salt, an amidino group, or a group capable of being released under alkaline conditions; m represents the integer 1, 2, or 3; and n and p each represent 0 or the integer 1.

DETAILED DESCRIPTION OF THE INVENTION

The compounds for use in the present invention are described in detail.

In formula (Ia) described above, Y represents a group which adsorbs onto silver halide as, for example, a nitrogen-containing heterocyclic group.

When Y represents a nitrogen-containing heterocyclic group, the compound of formula (Ia) is shown by formula (II)

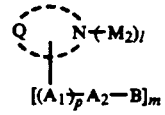

(II)

wherein l represents 0 or the integer 1; $[(A_1)_p A_2\text{—}B]_m$ has the same meaning as in formula (Ia) described above; and Q represents an atomic group necessary for forming a 5- or 6-membered heterocyclic ring composed of members selected from carbon, nitrogen, oxygen, and sulfur. The heterocyclic ring may be condensed with a carbon aromatic ring or a heteroaromatic ring.

Examples of the heterocyclic ring formed by Q include the indazoles, benzimidazoles, benzotriazoles, benzoxazoles, benzthiazoles, imidazoles, thiazoles, oxazoles, triazoles, tetrazoles, azaindenes, pyrazoles, indoles, triazines, pyrimidines, pyridines, and quinolines. These heterocyclic rings may be substituted as indicated below.

In formula (II), $M_2$ represents a hydrogen atom, an alkali metal atom (e.g., sodium and potassium), an ammonium group (e.g., trimethylammonium and dimethylbenzylammonium), or a group capable of being replaced with hydrogen or an alkali metal atom under alkali conditions (e.g., acetyl, cyanoethyl, and methanesulfonylethyl).

Also, these heterocyclic rings may be substituted by a nitro group, a halogen atom (e.g., chlorine and bromine), a mercapto group, a cyano group, a substituted or unsubstituted alkyl group (e.g., methyl, ethyl, propyl, t-butyl cyanoethyl, methoxyethyl, and methylthioethyl), a substituted or unsubstituted aryl group (e.g., phenyl, 4-methanesulfonamidophenyl, 4-methylphenyl, 3,4-dichlorophenyl, and naphthyl), a substituted or unsubstituted alkenyl group (e.g., allyl), a substituted or unsubstituted aralkyl group (e.g., benzyl, 4-methylbenzyl, and phenethyl), a substituted or unsubstituted alkoxy group (e.g., methoxy and ethoxy), a substituted or unsubstituted aryloxy group (e.g., phenoxy and 4-methoxyphenoxy), a substituted or unsubstituted alkylthio group (e.g., methylthio, ethylthio, and methoxyethylthio), a substituted or unsubstituted arylthio group (e.g., phenylthio), a substituted or unsubstituted sulfonyl group (e.g., methanesulfonyl, ethanesulfonyl, and p-toluenesulfonyl), a substituted or unsubstituted carbamoyl group (e.g., unsubstituted carbamoyl, methylcarbamoyl, and phenylcarbamoyl), a substituted or unsubstituted sulfamoyl group (e.g., unsubstituted sulfamoyl, methylsulfamoyl, and phenylsulfamoyl), a substituted or unsubstituted carbonamido group (e.g., acetamido group and benzamido group), a substituted or unsubstituted sulfonamido group (e.g., methanesulfonamido, benzenesulfonamido, and p-toluene, sulfonamido), a substituted or unsubstituted acyloxy group (e.g., acetyloxy and benzoyloxy), a substituted or unsubstituted sulfonyloxy group (e.g., methanesulfonyloxy), a substituted or unsubstituted ureido group (e.g., unsubstituted ureido, methylureido, ethylureido, and phenylureido), a substituted or unsubstituted thioureido group (e.g., unsubstituted thioureido and methylthioureido), a substituted or unsubstituted acyl group (e.g., acetyl and benzyl), a substituted or unsubstituted heterocyclic group (e.g., 1-morpholino, 1-piperidino, 2-pyridyl, 4-pyridyl, 2-thienyl, 1-pyrazolyl, 1-imidazolyl, 2-tetrahydrofuryl, and tetrahydrothienyl), a substituted or unsubstituted oxycarbonyl group (e.g., methoxycarbonyl and phenoxycarbonyl), a substituted or unsubstituted oxycarbonylamino group (e.g., methoxycarbonylamino, phenoxycarbonylamino, and 2-ethylhexyloxycarbonylamino), a substituted or unsubstituted amino group (e.g., unsubstituted amino, dimethylamino, methoxyethylamino, and anilino), a carboxylic acid or a salt thereof, a sulfonic acid or a salt thereof, a hydroxy group, etc.

Examples of the divalent linkage group shown by $A_1$ include: —S—, —O—,

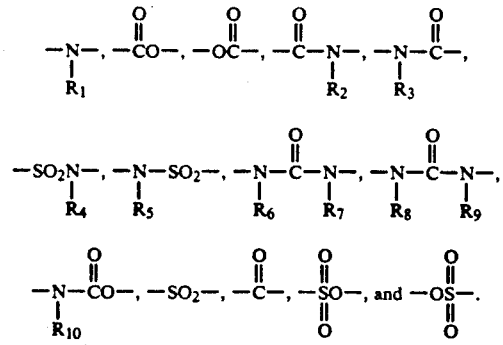

In the above formulae, $R_1$, $R_2$, $R_3$, $R_4$, $R_5$, $R_6$, $R_7$, $R_8$, $R_9$, and $R_{10}$ each represents a hydrogen atom, a substituted or unsubstituted alkyl group (e.g., methyl, ethyl, propyl, and n-butyl), a substituted or unsubstituted aryl group (e.g., phenyl and 2-methylphenyl), a substituted or unsubstituted alkenyl group (e.g., propenyl and 1-methylvinyl), or a substituted or unsubstituted aralkyl group (e.g., benzyl and phenethyl).

The above divalent structures may be further combined with a straight chain or branched alkylene group preferably having to 1 to 6 carbon atoms and more preferably 1 to 3 carbon atoms (e.g., methylene, ethylene, propylene, butylene, hexylene, and 1-methylethylene) to also comprise $A_1$,

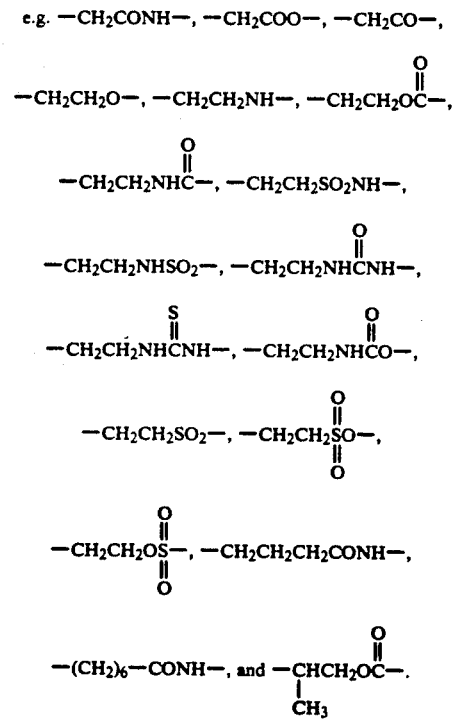

In formula (II), $A_2$ represents a divalent linkage group such as a straight chain or branched alkylene group (e.g., methylene, ethylene propylene, butylene, hexylene, and 1-methylethylene), a straight chain or branched alkenylene group (e.g., vinylene and 1-methylvinylene), a straight chain or branched aralkylene group (e.g., benzylidene), a straight chain or branched arylene group (e.g., phenylene and naphthylene), etc.

$A_1$ and $A_2$ in formula (II) may be further substituted with the groups represented by $A_1$ and $A_2$.

The substituted or unsubstituted amino group shown by B in formula (II) is shown by formula (VII).

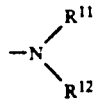

(VII)

Wherein $R^{11}$ and $R^{22}$, which may be the same or different, each represents a hydrogen atom, a substituted or unsubstituted alkyl, alkenyl group or aralkyl group having from 1 to 30 carbon atoms and these groups may be straight chain groups (e.g., methyl, ethyl, n-propyl, n-butyl, n-octyl, allyl, 3-butenyl, benzyl, and 1-naphthylmethyl), branched groups (e.g., iso-propyl and t-octyl), or cyclic groups (e.g., cyclohexyl).

Also, $R^{11}$ and $R^{12}$ may combine with each other to form a ring which may contain at least one hetero atom (e.g., oxygen, sulfur and nitrogen) so as to form a saturated heterocyclic ring such as pyrrolidyl, piperidyl, morpholino, etc.

Furthermore, substituents for $R^{11}$ and $R^{12}$ include a carboxy group, a sulfo group, a cyano group, a halogen atom (e.g., fluorine, chlorine, and bromine), a hydroxy group, an alkoxycarbonyl group having from 1 to 20 carbon atoms (e.g., methoxycarbonyl, ethoxycarbonyl, phenoxycarbonyl, and benzyloxycarbonyl), an alkoxy group having from 1 to 20 carbon atoms (e.g., methoxy, ethoxy, benzyloxy, and phenetyloxy), an aryloxy group having not more than 20 carbon atoms (e.g., phenoxy and p-tolyloxy), an acyloxy group having not more than 20 carbon atoms (e.g., acetyloxy and propionyloxy), an acyl group having not more than 20 carbon atoms (e.g., acetyl, propionyl, benzoyl, and mesyl), a carbamoyl group (e.g., carbamoyl, N,N-dimethylcarbamoyl, morpholinocarbonyl, and piperidinocarbonyl), a sulfamoyl group (e.g., sulfamoyl, N,N-dimethylsulfamoyl, morpholinosulfonyl, and piperidinosulfonyl), an acylamino group having not more than 20 carbon atoms (e.g., acetylamino, propionylamino, benzoylamino, mesylamino), a sulfonamido group (e.g., ethylsulfonamido and p-toluenesulfonamido), a carbonamido group having not more than 20 carbon atoms (e.g., methylcarbonamido and phenylcarbonamido), a ureido group having not more than 20 carbon atoms (e.g., methylureido and phenylureido), an amino group (same ones as defined in formula (VII)), etc.

The ammonium group shown by B is generally shown by formula (VIII).

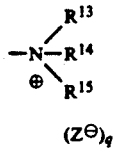

(VIII)

wherein $R^{13}$, $R^{14}$, and $R^{15}$ have the same meaning as $R^{11}$ and $R^{12}$ in formula (VII) as described above and $Z^{\theta}$ represents an anion such as halide ion (e.g., $Cl^{\theta}$, $Br^{\theta}$ and $I^{\theta}$) a sulfonate ion (e.g., trifluoromethanesulfonate ion, p-toluenesulfonate ion, benzenesulfonate ion, and p-chlorobenzenesulfonate ion), a sulfate ion (e.g., ethyl sulfate ion and methyl sulfate ions), a prechlorate ion, a tetrafluoroborate ion, etc. Also, q represents the integer 0 or 1 and when the compound forms an intramolecular salt, q is 0.

As a nitrogen-containing heterocyclic ring, B is a 5- or 6-membered ring containing at least one nitrogen atom and the ring may have substituents or may be condensed with another ring. Examples of the nitrogen containing heterocyclic ring are an imidazolyl ring, a pyridyl ring, and a thiazolyl ring.

Preferred embodiments of formula (II) are shown by formulae (III), (IV), (V), or (VI);

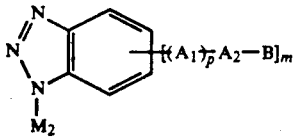

(III)

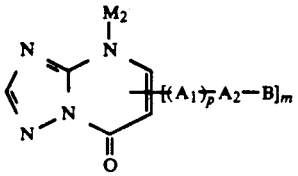

(IV)

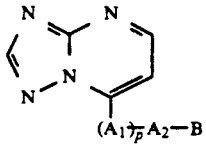

(V)

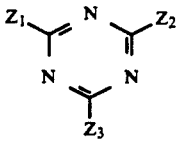

(VI)

wherein $(A_1)_p$—$A_2$—B, $M_2$ and m have the same meaning as defined above in formula (II); $Z_1$, $Z_2$, and $Z_3$ have the same meaning as $(A_1)_pA_2$—B in formula (Ia) or each represents a halogen atom, an alkoxy group having from 1 to 20 carbon atoms (e.g., methoxy), a hydroxy group, a hydroxyamino group, or a substituted or unsubstituted amino group. The substituent for the amino group can be selected from the aforesaid substituents for $R^{11}$ and $R^{12}$ in formula (VII). At least one of $Z_1$, $Z_2$, and $Z_3$ must have the same meaning as $(A_1)_pA_2$—B.

These heterocyclic rings may be substituted by the substituents applied to the heterocyclic ring shown by Q in formula (II) as described above.

The heterocyclic ring shown by X in formula (Ib) described above is a 5- or 6-membered heterocyclic ring containing at least one of nitrogen, oxygen, selenium, and sulfur and may be condensed with a carbon aromatic ring or a hetero aromatic ring. The heterocyclic ring is preferably aromatic and examples thereof are tetrazole, triazole, thiadiazole, oxadiazole, selenadiazole, imidazole, thiazole, oxazole, benzimidazole, benzthiazole, benzoxazole, benzselenazole, and pyrimidine. Among them, tetrazole and thiazole are particularly preferred.

These heterocyclic rings may be substituted by the same substituents applied to the heterocyclic rings shown by Q in formula (II).

The divalent linkage group shown by $A_3$ in formula (Ib) is a divalent linkage group composed of an atom or an atomic group selected from hydrogen, carbon, nitrogen, oxygen, and sulfur. Examples thereof are those illustrated as the linkage groups of $A_1$ and $A_2$ in formula (Ia) and a straight chain or branched alkinylene group (e.g., —CH—C≡C—CH—). The linkage group shown by $A_3$ may further comprise a linkage group by combinations of $A_1$, $A_2$ and/or an alkinylene group, e.g., $-CONH-(CH_2)_2-\overset{CH_3}{\underset{|}{N}}-(CH_2)_2-$,

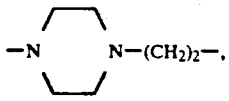

$-CONH-(CH_2)_2-S-(CH_2)_2-$, $-CH_2S-(CH_2)_2-$,

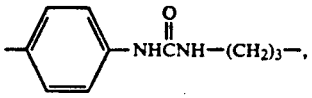

$-NH\underset{\underset{O}{\|}}{C}NH-(CH_2)_2-S-(CH_2)_3-$, $-NH\underset{\underset{O}{\|}}{C}NH-(CH_2)_2-S-(CH_2)_2-$, $-S-(CH_2)_2-S-(CH_2)_3-$, and $-NH\underset{\underset{O}{\|}}{C}-(CH_2)_2-\underset{\underset{O}{\|}}{C}NH-(CH_2)_2-$.

The alkali metal shown by $M_1$ in formula (Ib) includes $Na^+$, $K^+$, $Li^+$, etc. The alkaline earth metal shown by $M_1$ includes $Ca^{++}$, $Mg^{++}$, etc. The quaternary ammonium salt shown by $M_1$ has from 4 to 30 carbon atoms and examples thereof includes, $(CH_3)_4N^{\theta}$, $(C_2H_5)_4N^{74}$, $(C_4H_9)_4N^{\theta}$, $C_6H_5CH_2N^{74}(CH_3)_3$, and $C_{16}H_{33}N^{\theta}(CH_3)_3$. Also, examples of the quaternary phosphonium salt include $(C_4H_9)_4P^{\theta}$, $C_{16}H_{33}P^{\theta}(CH_3)_3$, and $C_6H_5CH_2P^{\theta}(CH_3)_3$.

The group shown by $M_1$, which can be replaced with hydrogen or an alkali metal atom under alkali conditions include an acetyl group, a cyanoethyl group, a methanesulfonylethyl group, etc.

Specific examples of the compound shown by formula (Ia) are illustrated below but the invention is not limited to these examples.

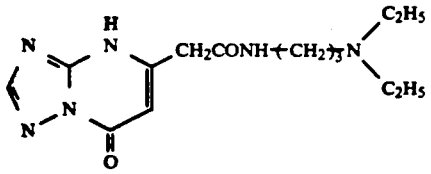

Ia-1

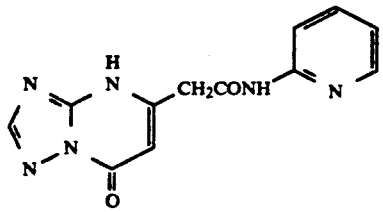

Ia-2

-continued

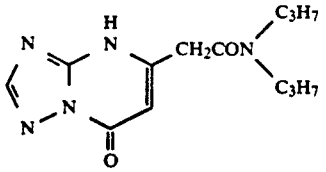

Ia-3

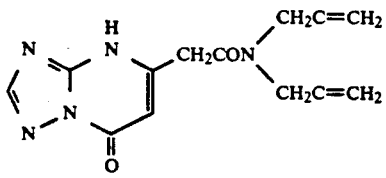

Ia-4

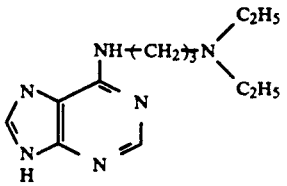

Ia-5

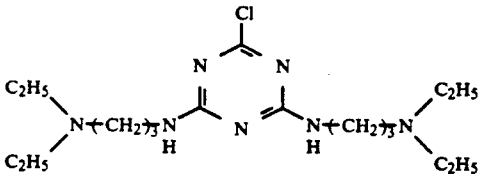

Ia-6

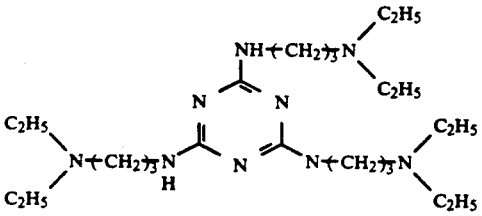

Ia-7

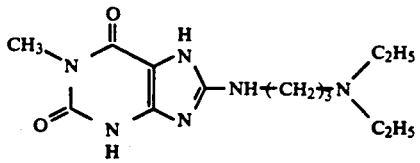

Ia-8

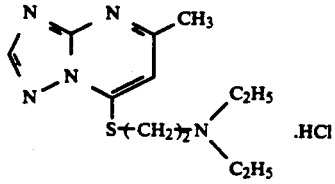

Ia-9

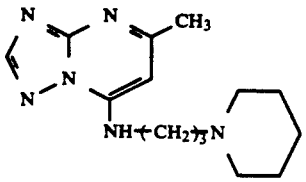

Ia-10

-continued
Ia-11
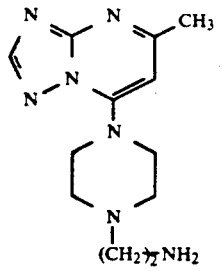
Ia-12
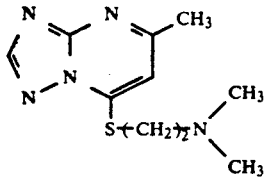
Ia-13
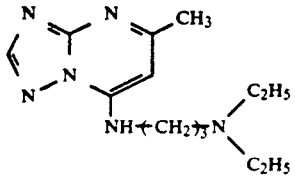
Ia-14
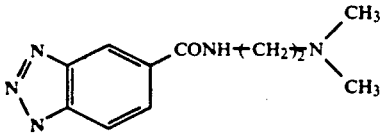
Ia-15
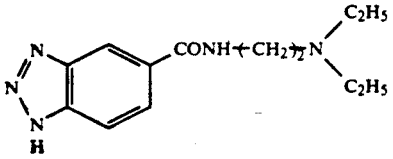
Ia-16
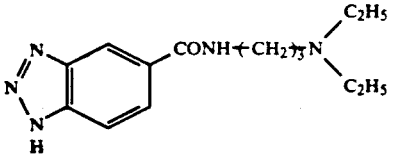
Ia-17
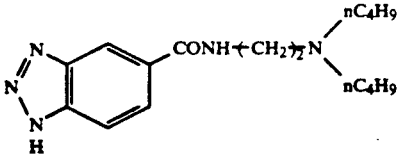
Ia-18
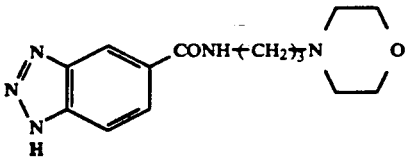
Ia-19
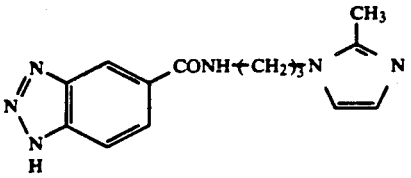
-continued
Ia-20
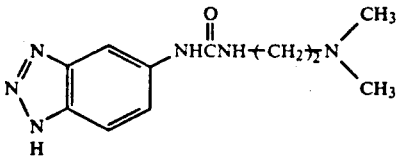
Ia-21
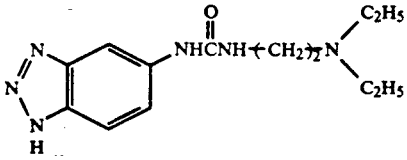
Ia-22
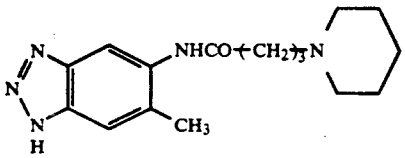
Ia-23
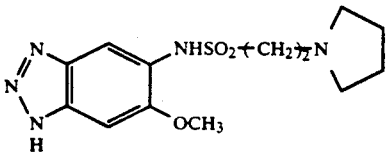
Ia-24
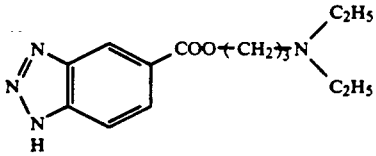
Ia-25
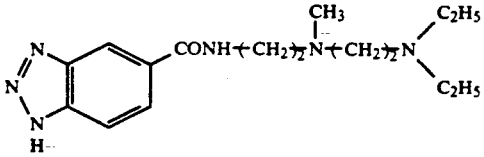
Ia-26
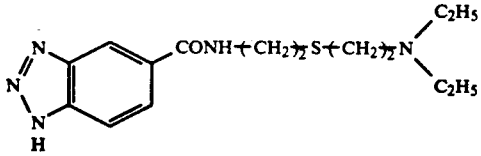
Ia-27
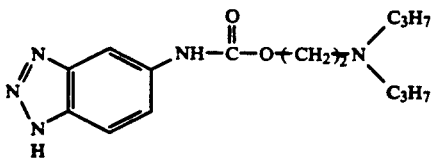
Ia-28
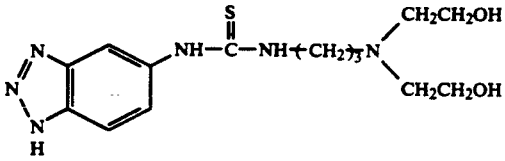

-continued
Ia-29
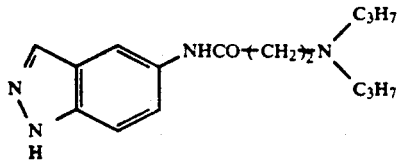
Ia-30
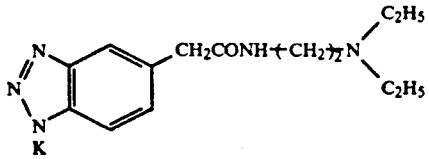
Ia-31
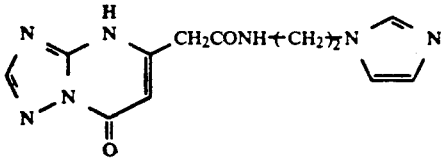
Ia-32
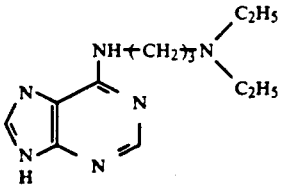
Ia-33
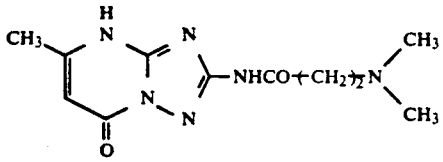
Ia-34
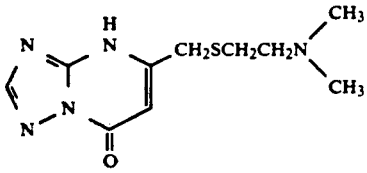
Ia-35
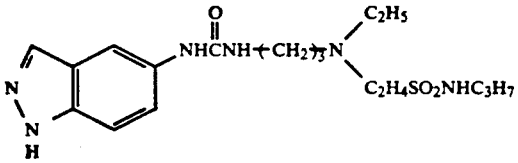
Ia-36
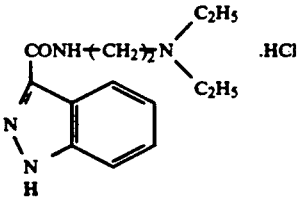
Ia-37
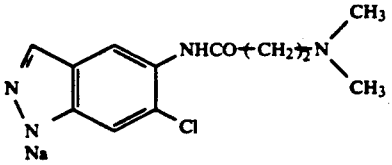
-continued
Ia-38
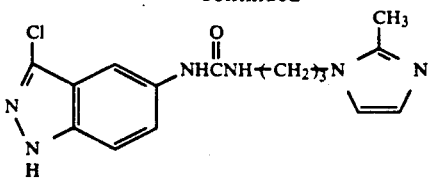
Ia-39
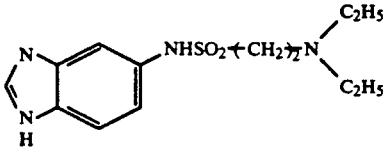
Ia-40
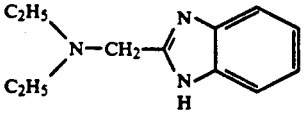
Ia-41
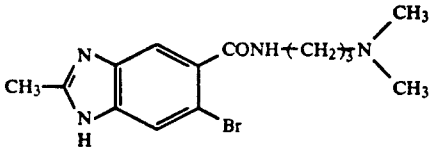
Ia-42
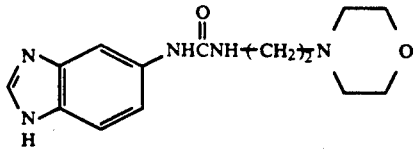
Ia-43
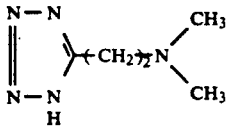
Ia-44
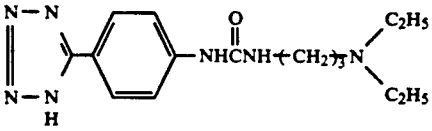
Ia-45
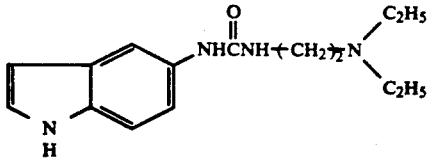
Ia-46
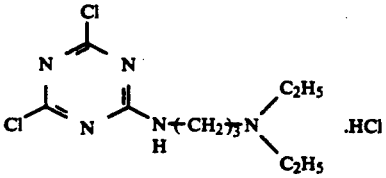
Specific examples of the compound of formula (Ib) are illustrated below but the invention is not limited to these examples.

Ib-1
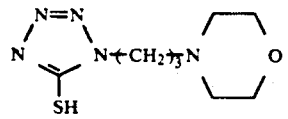
Ib-2
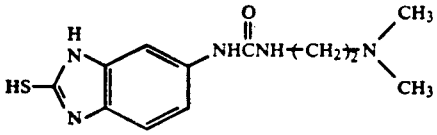
Ib-3
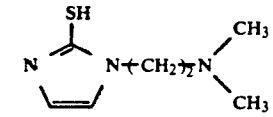
Ib-4
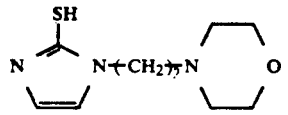
Ib-5
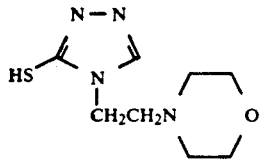
Ib-6
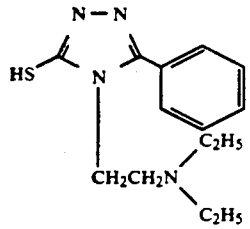
Ib-7
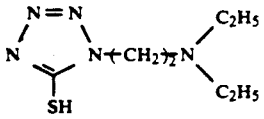
Ib-8
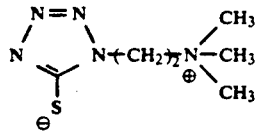
Ib-9
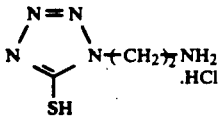
Ib-10
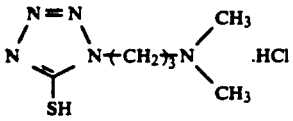
Ib-11
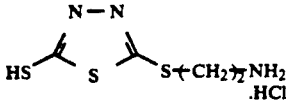
-continued
Ib-12
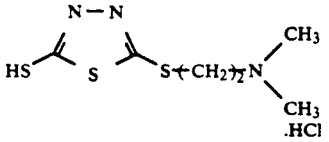
Ib-13
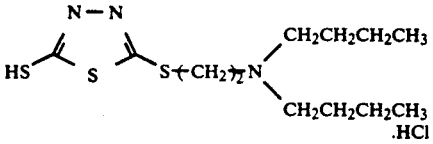
Ib-14
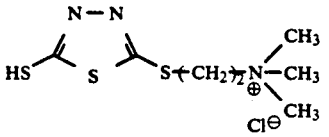
Ib-15
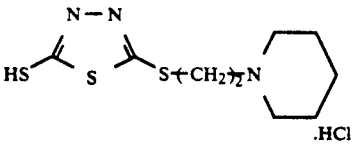
Ib-16
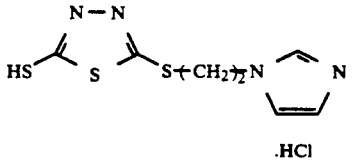
Ib-17
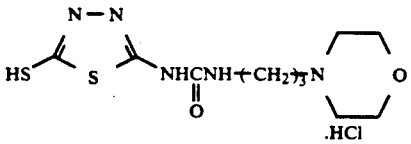
Ib-18
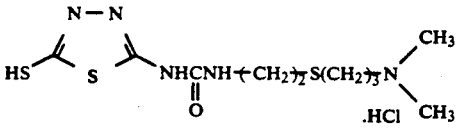
Ib-19
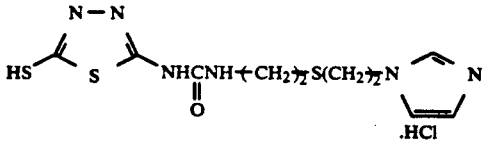
Ib-20
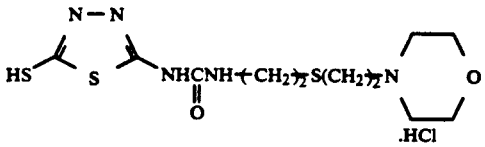
Ib-21
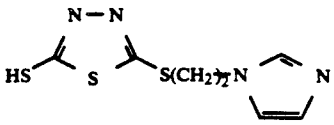

-continued
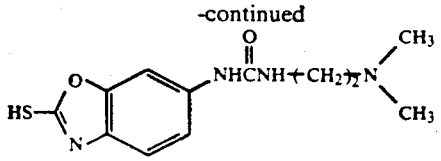
Ib-22
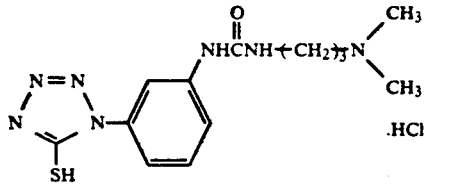
Ib-23
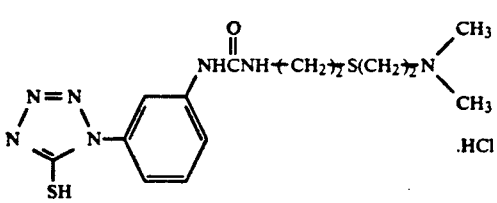
Ib-24
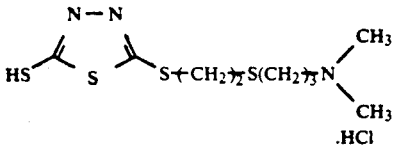
Ib-25
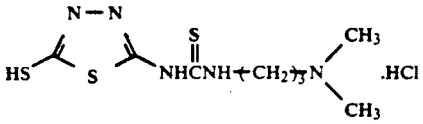
Ib-26
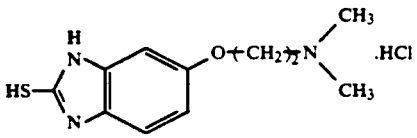
Ib-27
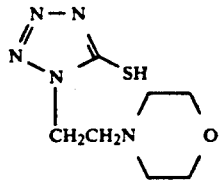
Ib-28
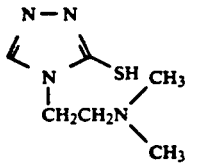
Ib-29
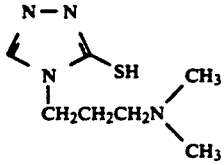
Ib-30
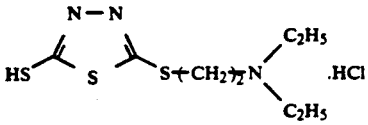
Ib-31
-continued
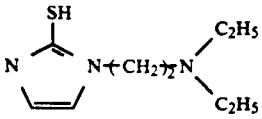
Ib-32
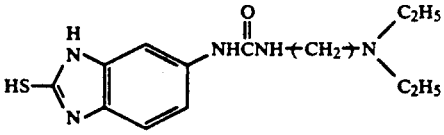
Ib-33
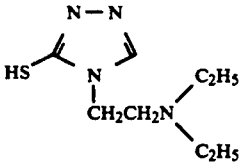
Ib-34
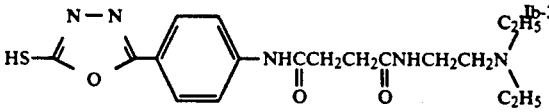
Ib-35
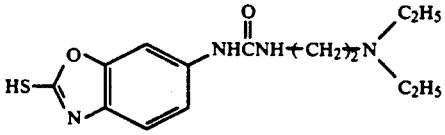
Ib-36
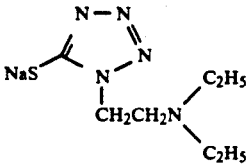
Ib-37
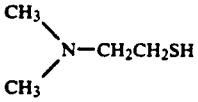
Ib-38
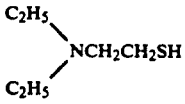
Ib-39
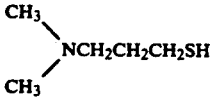
Ib-40
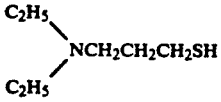
Ib-41
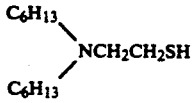
Ib-42
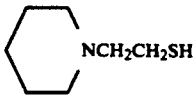
Ib-43

-continued

Ib-44

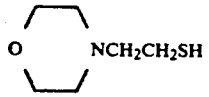

Ib-45

$(HOCH_2CH_2)_2NCH_2CH_2SH$

Ib-46

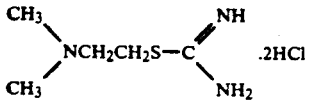

Ib-47

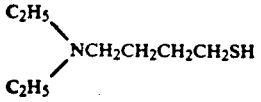

The nucleation accelerators shown by formulae (Ia) and (Ib) are readily synthesized by the methods described in *Berichte der Deutschen Chemischen Gesellschaft*, 28, 77(1895), ibid., 22, 568 (1889), ibid., 29, 2483(1896), *Journal of Chemical Society*, 1932, 1806, *Journal of The American Chemical Society*, 71, 4000(1949), *Advances in Heterocyclic Chemistry*, 9, 165(1968), *Organic Synthesis, IV*, 569(1963), *Journal of The American Chemical Society*, 45, 2390(1923), Chemische Berichte, 9, 465(1976), JP-A-50-37436 and JP-A-51-3231, U.S. Pat. Nos. 3,295,976, 3,376,310, 2,585,388, and 2,541,924, JP-B-40-28496, JP-B-43-41353, JP-B-60-29390, JP-B60-29391, JP-B-60-133061, and JP-B-61-1431 (the term "JP-B" as used herein means an "examined published Japanese patent application"), U.S. Pat. Nos. 3,106,467, 3,420,670, 2,271,229, 3,137,578, 3,148,066, 3,511,663, 3,060,028, 3,271,154, 3,251,691, 3,598,599, 3,148,066, 3,615,616, 3,420,664, 3,071,465, 2,444,605, 2,444,606, 2,444,607, and 2,935,404, and JP-A-50-89034, JP-A-57-202531, JP-A-57-167023, JP-A-57-164735, JP-A-60-80839, JP-A-58-152235, JP-A-57-14836, JP-A-59-162546, JP-A-60-130731, JP-A-60-138548, JP-A-58-83852, JP-A-58-159529, JP-A-59-159162, JP-A-60-217358, and JP-A-61 80238.

These accelerators may be used singly or in combination thereof.

The hydrazine derivative for use in the present invention includes those having a sulfinyl group as described in U.S. Pat. No. 4,478,928 and the compound shown by formula (IX).

$$R_{21}—NHNH—CHO \quad (IX)$$

wherein $R_{21}$ represents an aliphatic group or an aromatic group.

The aliphatic group shown by $R_{21}$ in formula (IX) is preferably an aliphatic group having from 1 to 30 carbon atoms. A straight chain, branched, or cyclic alkyl group having from 1 to 20 carbon atoms is preferred. The branched alkyl group may be cyclized so as to form a saturated heterocyclic ring containing at least one hetero atom. Also, the aforesaid alkyl group may have a substituent such as an aryl group, an alkoxy group, a sulfoxy group, a sulfonamido group, a carbonamido group, etc.

Examples thereof are t-butyl, n-octyl, t-octyl, cyclohexyl, pyrrolidyl, imidazolyl, tetrahydrofuryl, and morpholino.

The aromatic group shown by $R_{21}$ in formula (IX) is a monocyclic or dicyclic aryl group or an unsaturated heterocyclic group. The unsaturated heterocyclic group may be condensed with a monocyclic or dicyclic aryl group to form a heteroaryl group.

Examples thereof are a benzene ring, a naphthalene ring, a pyridine ring, a pyrimidine ring, an imidazole ring, a pyrazole ring, a quinoline ring, an isoquinoline ring, a benzimidazole ring, a thiazole ring, and a benzothiazole ring. Among them, the groups having a benzene ring are preferred.

$R_{21}$ is a particularly preferred aryl group.

The aryl group or aromatic group shown by $R_{21}$ may be substituted. Typical examples of the substituent include a straight chain, branched, or cyclic alkyl group (preferably having from 1 to 20 carbon atoms), an aralkyl group (preferably a monocyclic or dicyclic ring the alkyl moiety of which has from 1 to 3 carbon atoms), an alkoxy group (preferably having from 1 to 20 carbon atoms), a substituted amino group (preferably an amino group substituted by an alkyl group having from 1 to 20 carbon atoms), an acylamino group (preferably having from 2 to 30 carbon atoms), a sulfonamido group (preferably having from 1 to 30 carbon atoms) and a ureido group (preferably having from 1 to 30 carbon atoms).

$R_{21}$ in formula (IX) may have therein a ballast group being usually used to immobilize photographic additives such as couplers, etc. The ballast group is a group having at least 8 carbon atoms and is relatively inert to photographic properties. Examples thereof include an alkyl group, an alkoxy group, a phenyl group, an alkylphenyl group, a phenoxy group, and an alkylphenoxy group.

$R_{21}$ in formula (IX) may have therein a group for enhancing the adsorption onto the surface of silver halide grains. Such adsorptive groups include a thiourea group, a heterocyclic thioamido group, a mercaptoheterocyclic group, a triazole group, etc., as disclosed in U.S. Pat. No. 4,385,108.

Synthesis methods for the compounds shown by formula (IX) are disclosed in JP-A-53-20921, JP-A-53-20922, JP-A-53-66732, JP-A-53-20318, etc.

Specific examples of the compound shown by formula (IX) are illustrated below, but the invention is not limited to these compounds.

IX-1

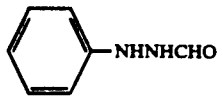

IX-2

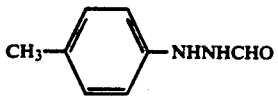

-continued
IX-3
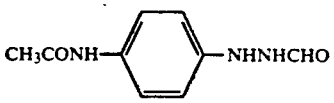
IX-4
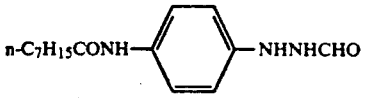
IX-5
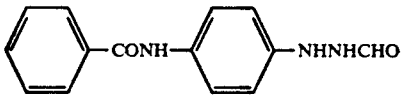
IX-6
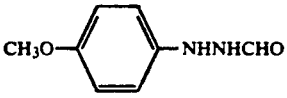
IX-7
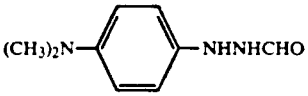
IX-8
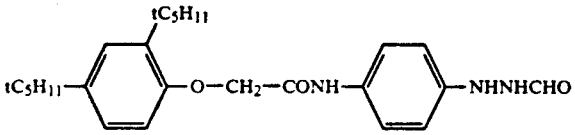
IX-9
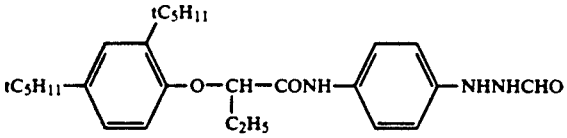
IX-10
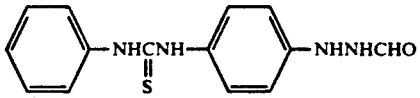
IX-11
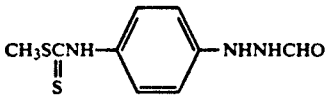
IX-12
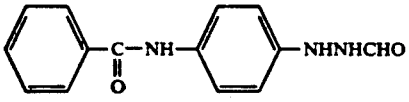
IX-13
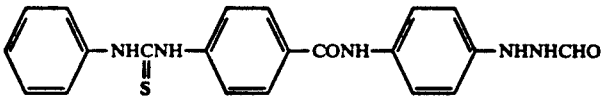
IX-14
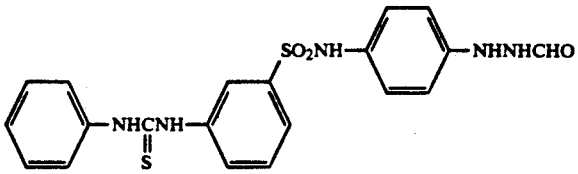

-continued
IX-15
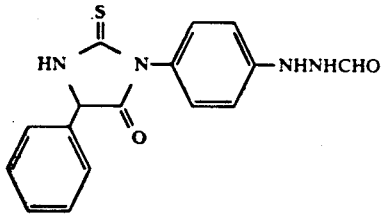
IX-16
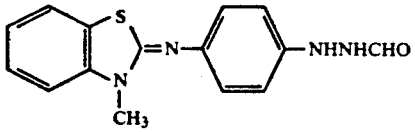
IX-17
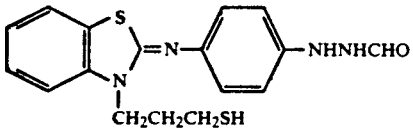
IX-18
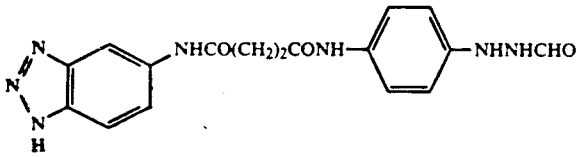
IX-19
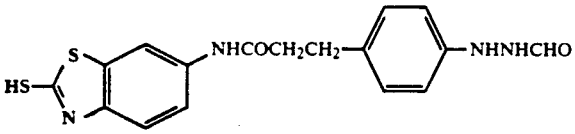
IX-20
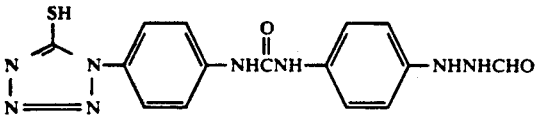
IX-21
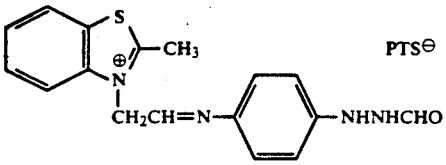
IX-22
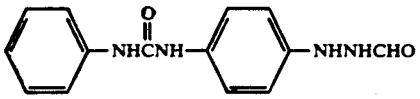
IX-23
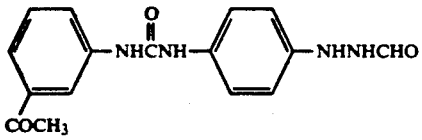
IX-24
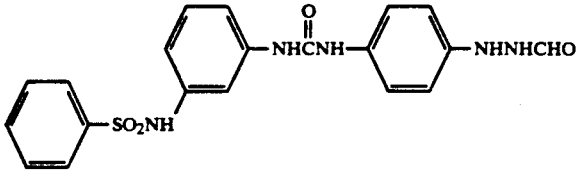

-continued
IX-25
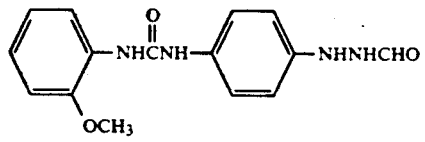
IX-26
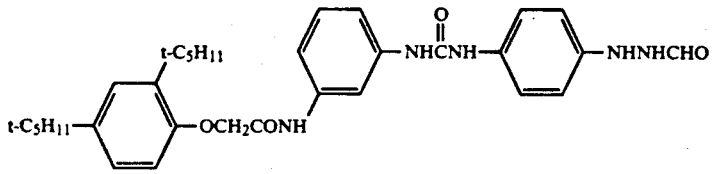
IX-27
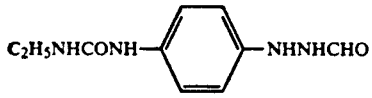
IX-28
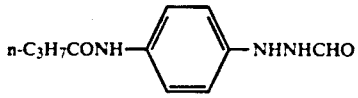
IX-29
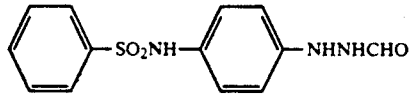
IX-30
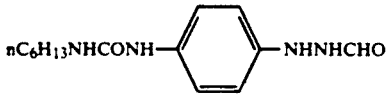
IX-31
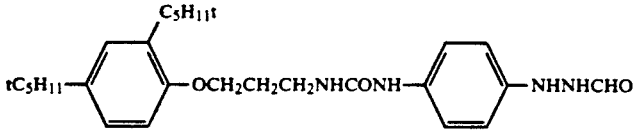
IX-32
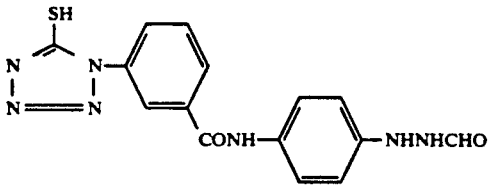
IX-33
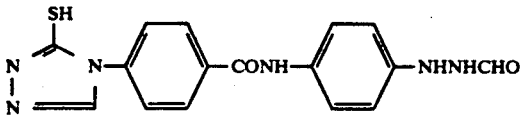
IX-34
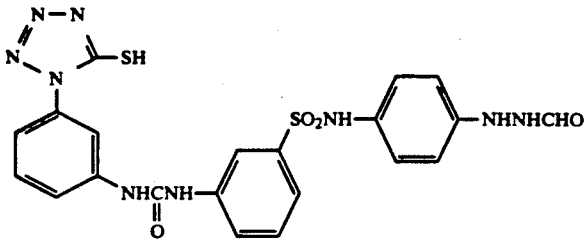

-continued

IX-35

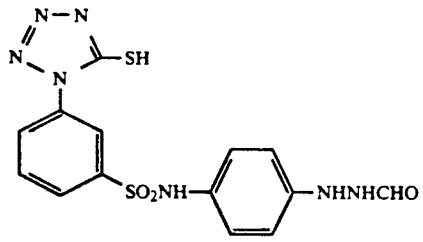

Other examples of the compound shown by formula (IX) are the following compounds disclosed in U.S. Pat. No. 4,478,928.

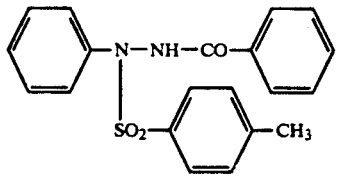

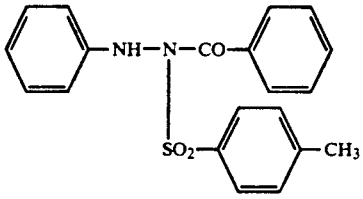

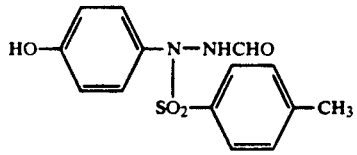

In the present invention, particularly preferred compounds of formula (IX) have therein a group which enhances adsorption onto the surface of silver halide grains. Such adsorptive groups include a thiourea group, a heterocyclic thioamido group, a mercaptoheterocyclic group, a triazole group, etc. as disclosed in U.S. Pat. No. 4,385,108. The preferred substituents for the aryl group or aromatic group shown by $R_1$ include an amido group, a ureido group, a thiourea group, etc. A sulfonamido group is particularly preferred.

The nucleation accelerator and the hydrazine derivative of the present invention are preferably incorporated in a silver halide emulsion layer, but they may also be incorporated in other light-insensitive hydrophilic colloid layers (e.g., protective layer, interlayer, filter layer, antihalation layer, etc.), preferably those adjacent to a silver halide emulsion layer. They may be added in the same layer or different layers. Water soluble compound of formulae (Ia), (Ib) and (IX) may be added to the hydrophilic colloid solution as an aqueous solution thereof. Conversely, when the compound is sparingly soluble in water, the compound may be added thereto as a solution in an organic solvent which is miscible with water. Examples of solvent include water, methanol, ethanol, acetone, dimethylformamide, methylcellosolve, etc. When the compound of formula (Ia), (Ib) or (IX) is incorporated into the silver halide emulsion layer, the addition may be performed at any optional time from the initiation of chemical ripening to just prior to coating, but the compound is preferably added thereto after chemical ripening is complete and prior to coating. It is particularly preferred to add the compound to the coating composition prepared for coating.

The optimal amount of the compounds of formula (Ia), (Ib) and (IX) are selected according to the grain size and the halogen composition of the silver halide emulsion, the method and extent of chemical sensitization, the relation between the layer(s) in which the compounds are incorporated and a silver halide emulsion, and the kind of an antifoggant.

The addition amount of the compound of formula (Ia) for use in the present invention is preferably from 5 $mg/m^2$ to 500 $mg/m^2$, and 10 $mg/m^2$ to 250 mg/m2 is particularly preferred. Also, the addition amount of the compound of formula (Ib) is preferably from 1 $mg/m^2$ to 250 $mg/m^2$, and 3 $mg/m^2$ to 150 $mg/m^2$ is particularly preferred. Furthermore, the addition amount of the compound of formula (IX) is preferably from 1 $mg/m^2$ to 300 $mg/m^2$, and 2 $mg/m^2$ to 200 $mg/m^2$ is particularly preferred. Also, the compound of formula (IX) wherein $R_{21}$ contains therein a group enhancing the adsorption onto the surface of silver halide grains is preferably added in an amount of from 2 $mg/m^2$ to 100 $mg/m^2$.

The photographic emulsion for use in the present invention may contain silver bromide, silver iodobromide, silver iodochlorobromide, silver chlorobromide, silver iodide, or silver chloride, but it is preferred that the silver halide contains at least 50 mol % silver chloride.

The silver halide grains in the photographic emulsion may have a regular crystal form such as cubic, octahedral, dodecahedral, tetradecahedral, etc.; an irregular crystal form such as sphere, tabular, etc.; or a composite of these crystal forms. The silver halide grains may be composed of a mixture of grains having various crystal forms.

The silver halide grains for use in the present invention may have different phase between the inside and the surface layer thereof or may be composed of a uniform phase throughout the whole grain.

During the formation or physical ripening of the silver halide grains, a cadmium salt, a zinc salt, a lead salt, a thallium salt, an iridium salt or a complex salt thereof, rhodium salt or a complex salt thereof, iron salt or a complex salt thereof, etc., may be present in the system.

Also, a silver halide solvent (e.g., ammonia, potassium rhodanate, and thioethers and thione compounds as described in U.S. Pat. No. 3,271,157, JP A-51-12360, JP-A-53-82408, JP-A-53-144319, JP-A-54-100717, and JP-A-54-155828) can be used as required in the present invention.

The silver halide emulsion for use in the present invention may or may not be chemically sensitized. Chemical sensitization for use in the present invention include a sulfur sensitization method using active gelatin or a sulfur-containing compound capable of reacting with silver (e.g., thiosulfates, thioureas, mercapto compounds, and rhodanines); a reduction sensitizing method using a reducing material (e.g., stannous salt, amines, hydrazine derivatives, formamidinesulfinic acid, silane compounds, etc.); a noble metal sensitization method using a metal compound (e.g., gold complex salts and complex salts of noble metals belonging to group VIII of the Periodic Table, such as Pt, Ir, Pd, etc.); or a combination thereof.

The silver halide emulsions for use in this invention can contain various compounds for preventing the formation of fog during the storage and/or photographic processing of the light-sensitive material or for stabilizing photographic performance. For example, such antifoggants or stabilizers include azoles (e.g., benzothiazoliums, nitroindazoles, triazoles, benzotriazoles, benzimidazoles (in particular, nitro- or halogen-substituted benzimidazoles)); heterocyclic mercapto compounds (e.g., mercaptothiazoles, mercaptobenzothiazoles, mercaptobenzimidazoles, mercaptothiadiazoles, mercaptotetrazoles (in particular, 1-phenyl-5-mercaptotetrazole), and mercaptopyrimidines), the aforesaid heterocyclic mercapto compounds having a watersolubilizing group such as a carboxy group and a sulfon group, thioketo compounds (e.g., oxazolinethione), azaindenes (e.g., tetraazaindenes (in particular, 4-hydroxy-substituted (1,3,3a,7)tetraazaindenes), benzenethiosulfonic acids, and benzenesulfinic acid.

The photographic emulsion for use in the present invention may be spectrally sensitized to relatively a long wavelength of blue light, green light, red light, or infrared light using sensitizing dyes. Such sensitizing dyes include cyanine dyes, merocyanine dyes, complex cyanine dyes, complex merocyanine dyes, holopolar cyanine dyes, styryl dyes, hemicyanine dyes, oxonol dyes, hemioxonol dyes, etc.

Practical examples of the spectral sensitizing dyes are disclosed in, for example, P. Glafkides, *Chemie Photographique*, 2nd edition, Chapters 35 to 41, published by Paul Montel, Paris, 1957, F. M. Hamer, *The Cyanine and Related Compound*, Interscience, U.S. Pat. Nos. 2,503,776, 3,459,553, and 3,177,210, and *Research Disclosure*, Vol. 176, No. 17643, Paragraph 23, IV-J, (December, 1978).

The photographic light-sensitive material being processed in the present invention may contain watersoluble dyes in the hydrophilic colloid layer(s) as filter dyes or for irradiation inhibition, etc. Such dyes include oxonol dyes, hemioxonol dyes, styryl dyes, merocyanine dyes, cyanine dyes and azo dyes. Among them, oxonol dyes, hemioxanol dyes, and merocyanine dyes are particularly useful.

Also, the photographic light-sensitive material of the present invention may further contain in the photographic emulsion layer(s) and other hydrophilic colloid layer(s) an inorganic or organic hardening agent. For example, active vinyl compounds (e.g., 1,3,5-triacryloyl-hexahydro-s-triazine and 1,3-vinylsulfonyl-2-propanol) and active halogen compounds (e.g., 2,4-dichloro-6-hydroxy-s-triazine) can be used singly or as a combination thereof.

Furthermore, the photographic light-sensitive material of the present invention may further contain in the photographic emulsion layer(s) or other hydrophilic colloid layer(s) various surface active agents.

Examples of surface active agent for use in the present invention are nonionic surface active agents such as saponin (steroid series), alkylene oxide derivatives (e.g., polyethylene glycol, polyethylene glycol/polypropylene glycol condensates, polyethylene glycol alkyl ethers, polyethylene glycol alkylaryl ethers, polyethylene glycol esters, polyethylene glycol sorbitan esters, polyalkylene glycol alkylamines, polyalkylene glycol alkylamides, and polyethylene oxide addition products of silicone), glycidol derivatives (e.g., alkenyl succinic acid polyglyceride and alkylphenol polyglyceride), aliphatic acid esters of polyhydric alcohols, alkyl esters of saccharide, etc.; anionic surface active agents containing an acid group (e.g., a carboxy group, a sulfo group, a phospho group, a sulfuric acid ester group, and a phosphoric acid ester group), such as alkyl carboxylates, alkyl sulfonates, alkylbenzenesulfonates, alkylnaphthalenesulfonates, alkylsulfuric acid esters, alkylphosphoric acid esters, N-acyl-N-alkyltaurins, sulfosuccinic acid esters, sulfoalkyl polyoxyethylene alkylphenyl ethers, polyoxyethylene alkylphosphoric acid esters, etc.; amphoteric surface active agents such as amino acids, aminoalkylsulfonic acids, aminoalkylsulfuric acid esters, aminoalkylphosphoric acid esters, alkylbetaines, amine oxides, etc.; and cationic surface active agents such as alkylamine salts, aliphatic quaternary ammonium salts, aromatic quaternary ammonium salts, heterocyclic quaternary ammonium salts (e.g., pyridinium and imidazolium), phosphonium or sulfonium salts containing an aliphatic or aromatic ring, etc.

The photographic emulsion layer(s) of the photographic light-sensitive material of the present invention may further contain polyalkylene oxide or the derivatives thereof such as the ethers, esters, amines, etc., thereof, thioether compounds, thiomorpholines, quaternary ammonium salt compounds, urethane derivatives, urea derivatives, imidazole derivatives, 3-pyrazolidone derivatives, etc., for increasing sensitivity, contrast, and/or accelerating development.

As the binder or protective colloid for the emulsion layer(s) and other hydrophilic colloid layer(s) of the photographic light-sensitive material of the present invention, gelatin is advantageously used, but other hydrophilic colloids can also be used.

For example, hydrophilic high molecular materials such as polyvinyl alcohol, polyvinyl alcohol partial acetal, poly-N-vinylpyrrolidone, polyacrylic acid, polyacrylamide, dextran, etc. may be used.

In order to obtain photographic characteristics of super high contrast using the silver halide photographic material of the present invention, a stable developer can be used without use of either a conventional infectious developer or a high alkaline developer of about pH 13 as described in U.S. Pat. No. 2,419,975.

That is, using the process of the present invention, super high contrast negative images are obtained by processing the light-sensitive material of the present invention with a developer containing a sulfite ion at a concentration of at least 0.15 mol/liter and having pH of from 9.6 to 11.0, and particularly from 10.0 to 11.0.

There is no particular restriction on the developing agent which can be used in the process of the present invention and, for example, dihydroxybenzenes (e.g., hydroquinone), 3-pyrazolidones (e.g., 1-phenyl-3-pyrazolidone, 4,4-dimethyl-1-phenyl-3-pyrazolidone), and aminophenols (e.g., N-methyl-p-aminophenol) can be used singly or in combination thereof.

The silver halide light-sensitive material of the present invention is preferably processed by a developer containing a dihydroxybenzene as the primary developing agent and a 3-pyrazolidone or an aminophenol as an auxiliary developing agent. In this case, it is preferred that the developer contain the dihydroxybenzene in the range of from 0.05 to 0.5 mol/liter and the 3-pyrazolidone or aminophenol in the range of less than 0.06 mol/liter.

Also, as disclosed in U.S. Pat. No. 4,269,929, by adding an amine to the developer, the developing speed can be increased to thus shorten the development time.

The developer for use in the present invention may further contain pH buffers such as sulfites, carbonates, borates, and phosphates of an alkali metal or development inhibitors or antifoggants such as bromides, iodides and organic antifoggants (nitroindazoles or benzotriazoles are particularly preferred). Also, if necessary, the developer may contain a water softener, a resolution aid, a toning agent, a development accelerator, a surface active agent (a polyalkylene oxide is particularly preferred), a defoaming agent, a hardening agent, and/or a silver stain inhibitor of films (e.g., 2-mercaptobenzimidazole sulfonic acids).

After development, the silver halide light-sensitive material is fixed in the present invention. Ordinary fixing compositions can be employed including thiosulfates, thiocyanates, and organic sulfur compounds which are known to have an effect as fixing agent. The fix solution may contain a water-soluble aluminum salt as a hardening agent.

The processing temperature in the process of the present invention is typically from 18° C. to 50° C.

An automatic processor is preferably used for the photographic processing of the present invention. Even when the total processing time is in the range of from 90 seconds to 120 seconds, negative photographic characteristics of super high contrast are obtained.

The developer for use in the present invention may contain the compound disclosed in JP-A-56-24347 as a silver stain inhibitor. Furthermore, the developer may contain the compound disclosed in JP-A-61-267759 as a resolution aid. Moreover, the developer may further contain the compound disclosed in JP-A-60-93433 or boron compounds disclosed in JP-A-62-186259.

The following examples are intended to illustrate the present invention but not to limit it in any way.

EXAMPLE 1

A silver chloroiodobromide emulsion (containing 0.1 mol % silver iodide and 30 mol % silver bromide) was prepared using a double jet method as shown below. For preparing the silver chloroiodobromide emulsion, $(NH_4)_3RhCl_6$ was added to the aqueous halide solution (containing KBr, NaCl and KI)as a rhodium salt at a concentration of $5\times10^{-6}$ mol/mol-Ag. $K_3IrCl_6$ was also added to the aqueous halide solution as an iridium salt at a concentration of $4\times10^{-7}$ mol/mol-Ag.

The aqueous halide solution thus prepared and an aqueous silver nitrate solution were added to an aqueous gelatin solution and mixed .for 60 minutes at 45° C to provide a mono-dispersed cubic grain size halide having a mean grain size of 0.25 μm. After washing the emulsion with water and desalting, $1\times10^{-5}$ mol/mol-Ag of sodium thiosulfate and $1\times10^{-5}$ mol/mol-Ag of potassium chloroaurate were added to the emulsion for gold sensitization. To the emulsion were further added $3\times10^{-4}$ mol/mol-Ag of 1-(2-hydroxyethoxyethyl)-3-(pyridin-2-yl)- 5-[(3-sulfobutyl-5-chloro-2-benzoxazolinidene)ethylidene]-2-thiohydrantoin potassium salt as a sensitizing dye, 1.5 g of 4-hydroxy-6-methyl-1,3,3a,7-tetraazaindene as a stabilizer, 2 g of hydroquinone, 2 g of resorcin aldoxium, and 0.1 g of 1-phenyl-5-mercaptotetrazole each per mol of silver.

Furthermore, to the emulsion were added the compound of formula $$C_{17}H_{33}CON(CH_3)-CH_2CH_2SO_3Na$$

and saponin as coating aids, the compound of formula $CH_2{=}CHSO_2CH_2CONH{-}(CH_2)_nNHCOCH_2SO_2CH{=}CH_2$ (n=2 or 3) as a hardening agent, sodium polystyrenesulfonate as a tackifier, and a dispersion of polyethyl acrylate as a latex polymer.

Moreover, to the emulsion were further added each of IX-9, IX-31, IX-20, IX-32, IX-34, and IX 35 as the hydrazine compound shown by formula.(IX) and each of Ia-15 and Ib-7 as a nucleation accelerator as shown in Table 1 below to provide the silver halide emulsion.

A coating composition for a protective layer was composed of an aqueous gelatin solution containing gelatin, sodium dodecylbenzenesulfonate, colloidal silica, a dispersion of polyethyl acrylate, polymethyl methacrylate (matting agents), and sodium polystyrenesulfonate (tackifier).

The aforesaid emulsion and the coating composition for the protective layer were simultaneously coated on a transparent plastic film support at a gelatin coverage of 1.6 g/m² for the protective layer and a silver coverage of 3.6 g/m² for the emulsion layer.

Each sample thus prepared was exposed to tungsten light of 3200° K through a sensitometric optical wedge for 5 seconds, developed by developer (A) or (D) having the composition shown below for 30 seconds at 38° C., fixed, washed, and dried. An automatic processor FG-660F, made by Fuji Photo Film Co., Ltd. was used for the development processing.

| Composition of Developer (A) | |
|---|---|
| Hydroquinone | 35.0 g |
| N-Methyl-p-aminophenol ½sulfate | 0.8 g |
| Sodium hydroxide | 9.0 g |
| Potassium tertiary phosphate | 74.0 g |
| Potassium sulfite | 90.0 g |
| Ethylenediaminetetraacetic acid di-sodium salt | 1.0 g |
| Potassium bromide | 3.0 g |
| 5-Methylbenzotriazole | 0.6 g |
| 3-Diethylamino-1-propanol | 15.0 g |
| Water to make | 1 liter |
| pH | 11.6 |

Developer (D) was prepared by adding acetic acid to developer (A) reducing the pH to 10.4.

Then, the $\overline{G}$ value of each sample thus processed was measured and the results obtained are shown in Table 1.

The $\overline{G}$ value is calculated by the equation $\overline{G}=[3.0-0.3]/\Delta\log E$ wherein $\Delta\log E$ is the difference in the exposure amounts (logE) necessary to attain the densities of 3.0 and 0.3, respectively.

Also, after placing 1 liter of each of the developers (A) and (D) in a one liter beaker and aged at room temperature and open to air for one week, the aforesaid sample was processed by the developer as described above and the $\overline{G}$ value was measured. The results are also shown in Table 1.

From the results shown in Table 1, it can be seen that by using the nucleation accelerator of the present invention, the $\overline{G}$ value is above 10, even at low developer pH. Also, development processing is stable as shown by the small difference in $\overline{G}$ value when using 1 week old developer.

TABLE 1

| | Hydrazine Compound | | Nucleation Accelerator | | $\overline{G}$ Fresh Developer | | $\overline{G}$ Developer Aged 1 Week | |
|---|---|---|---|---|---|---|---|---|
| Sample No. | Compound No. | Amount (mg/m²) | Compound No. | Amount (mg/m²) | Developer (A) pH 11.6 | Developer (D) pH 10.4 | Developer (A) pH 11.6 | Developer (D) pH 10.4 |
| (1) | IX-9 | 100 | Ia-15 | 100 | 25 | 10.5 | 9.5 | 10.2 |
| (2) | " | " | — | — | 15 | 5 | not measured | not measured |
| (3) | IX-31 | 100 | Ia-15 | 100 | 30 | 11 | 9.8 | 10.5 |
| (4) | " | " | — | — | 13 | 5 | not measured | not measured |
| (5) | IX-20 | 20 | Ia-15 | 100 | 30 | 15 | 12 | 13 |
| (6) | " | " | — | — | 18 | 5 | not measured | not measured |
| (7) | IX-32 | 20 | Ia-15 | 100 | 30 | 15 | 13 | 14 |
| (8) | " | " | — | — | 19 | 5 | not measured | not measured |
| (9) | IX-34 | 20 | Ia-15 | 100 | 38 | 20 | 18 | 19 |
| (10) | " | " | — | — | 25 | 5 | not measured | not measured |
| (11) | IX-35 | 20 | Ia-15 | 100 | 34 | 18 | 15 | 16 |
| (12) | " | " | — | — | 23 | 5 | not measured | not measured |
| (13) | IX-9 | 100 | Ib-7 | 20 | 24 | 10.5 | 9.5 | 10.2 |
| (14) | " | " | — | — | 15 | 5 | not measured | not measured |
| (15) | IX-31 | 100 | Ib-7 | 20 | 29 | 11 | 9.8 | 10.5 |
| (16) | " | " | — | — | 13 | 5 | not measured | not measured |
| (17) | IX-20 | 20 | Ib-7 | 20 | 29 | 15 | 12 | 13 |
| (18) | " | " | — | — | 18 | 5 | not measured | not measured |
| (19) | IX-32 | 20 | Ib-7 | 20 | 29 | 15 | 13 | 14 |
| (20) | " | " | — | — | 19 | 5 | not measured | not measured |
| (21) | IX-34 | 20 | Ib-7 | 20 | 37 | 20 | 18 | 19 |
| (22) | " | " | — | — | 25 | 5 | not measured | not measured |
| (23) | IX-35 | 20 | Ib-7 | 20 | 34 | 18 | 15 | 16 |
| (24) | " | " | — | — | 23 | 5 | not measured | not measured |
| (25) | — | — | — | — | 5 | 5 | not measured | not measured |

EXAMPLE 2

Developers (B), (C), (D), (E), (F), and (G) were prepared having the same composition as the developer in Example 1 except that the pH value was adjusted as shown in Table 2. Light-sensitive film prepared as in Sample No. 9 of Example 1 was processed using the developer of Example 1, as adjusted for pH, and the $\overline{G}$ value was then measured. The results are shown in Table 2. After placing one liter of each of the developers (A) to (G) in a one liter beaker and allowing to age at room temperature and open to air for one week, the light-sensitive film was processed using the one week old developer and the $\overline{G}$ value was measured. The results are also shown in Table 2.

TABLE 2

| | | $\overline{G}$ | |
|---|---|---|---|
| Developer | pH | Directly after Developer Preparation | Developer Aged 1 Week |
| (A) | 11.6 | 38 | 18 |

TABLE 2-continued

| | | $\overline{G}$ | |
|---|---|---|---|
| Developer | pH | Directly after Developer Preparation | Developer Aged 1 Week |
| (B) | 11.0 | 30 | 28 |
| (C) | 10.8 | 25 | 23 |
| (D) | 10.4 | 20 | 19 |
| (E) | 10.0 | 15 | 14 |
| (F) | 9.8 | 10 | 10 |
| (G) | 9.5 | 7 | 7 |

Developers (A) and (G): For comparison
Developers (B) to (F): For this invention From the results in Table 2, it can be seen that by using the compounds of the present invention, a super high contrast value of at least a $\overline{G}$ of 10 is obtained and the $\overline{G}$ value remains stable, using aged developer, in the claimed pH range.

EXAMPLE 3

The same procedure was followed as for Sample No. 9 in Example 1 except that each of Ia-16 and Ia-21 was added in place of Ia-15 to prepare Sample Nos. 26 and 27. Each sample was processed as in Example 1 and the $\overline{G}$ value was measured. The results are shown in Table 3

TABLE 3

| Sample No. | $\bar{G}$ Fresh Developer pH 11.6 (A) | $\bar{G}$ Fresh Developer pH 10.4 (D) | $\bar{G}$ After 1 Week Developer pH 11.6 (A) | $\bar{G}$ After 1 Week Developer pH 10.4 (D) |
|---|---|---|---|---|
| 26 | 35 | 18 | 15 | 17 |
| 27 | 32 | 15 | 12 | 14 |

From the results above, it can be seen that by using the compounds in the present invention, a super high contrast of $\bar{G}$ greater than 10 is obtained at low pH and processing stability is maintained in the case of using the developer of low pH.

EXAMPLE 4

Developers (A), (B), (C), (D), (E), (F), and (G) were prepared as in Example 2. Also, by following the same procedure as Sample 23 in Example 1, a light-sensitive material was prepared, processed as in Example 1 using the developers (A) to (G) and the $\bar{G}$ value was measured. The results are shown in Table 4. Also, after placing one liter of each of the developers (A) to (G) in a one liter beaker and exposing the developer to air at room temperature for one week, the samples were processed as above using the developers (A) to (G) and the $\bar{G}$ value was measured. The results are shown in Table 4.

TABLE 4

| Developer | pH | $\bar{G}$ Fresh | $\bar{G}$ After one week |
|---|---|---|---|
| (A) | 11.6 | 34 | 15 |
| (B) | 11.0 | 30 | 28 |
| (C) | 10.8 | 25 | 23 |
| (D) | 10.4 | 18 | 16 |
| (E) | 10.0 | 15 | 14 |
| (F) | 9.8 | 10 | 10 |
| (G) | 9.5 | 7 | 7 |

Developers (A) and (G): For Comparison.
Developers (B) to (F): For the Invention.

From the results shown above, it can be seen that by using the compounds in this invention, a super high contrast of $\bar{G}$ at least 10 is obtained, and the $\bar{G}$ value remains stable, using aged developer, in the claimed pH range.

EXAMPLE 5

By following the same procedure as Sample No. 23 in Example 1 except that each of Ib-10 and Ib-31 was used in place of Ib-7 as the nucleating accelerator, Sample Nos. 28 and 29 were prepared. Each sample was processed as in Example, 1 and the $\bar{G}$ value was measured. The results are shown in Table 5. Also, the developer was aged for one week as in Example 1, each sample was processed using the developers (A) and (B), and the $\bar{G}$ value was measured. The results are shown in Table 5.

TABLE 5

| Sample No. | $\bar{G}$ Fresh (A) | $\bar{G}$ Fresh (B) | $\bar{G}$ After 1 Week (A) | $\bar{G}$ After 1 Week (B) |
|---|---|---|---|---|
| 28 | 30 | 17 | 14 | 16 |
| 29 | 28 | 14 | 12 | 13 |

As shown in the above results, it can be seen that by using the compounds of the present invention, super high contrast of $\bar{G}$ value greater than 10 is obtained, and the $\bar{G}$ value remains stable and stability can be kept when using a developer having low pH.

While the invention has been described in detail and with reference to specific embodiments thereof, it will be apparent to one skilled in the art that various changes and modifications can be made therein without departing from the spirit and scope thereof.

What is claimed is:

1. A process for forming super high contrast negative images, which comprises processing a super high contrast negative type silver halide photographic material comprising a support having thereon at least one layer, one of which must be a silver halide emulsion layer, said silver halide emulsion layer or other hydrophilic colloid layer containing at least one hydrazine derivative represented by formula (IX)

$$R_{21}\text{—NHNH—CHO} \qquad \text{(IX)}$$

where $R_{21}$ represents an aliphatic group or an aromatic group and at least one nucleation accelerator represented by the following formula (Ia) with a developer having a pH of from 9.6 to 11.0;

$$Y\text{-}[(A_1)_p A_2\text{—}B]_m \qquad \text{(Ia)}$$

wherein Y represents a group adsorbing onto silver halide; $A_1$ represents a divalent linkage group composed of an atom or an atomic group selected from hydrogen, carbon, nitrogen, oxygen, and sulfur and selected from

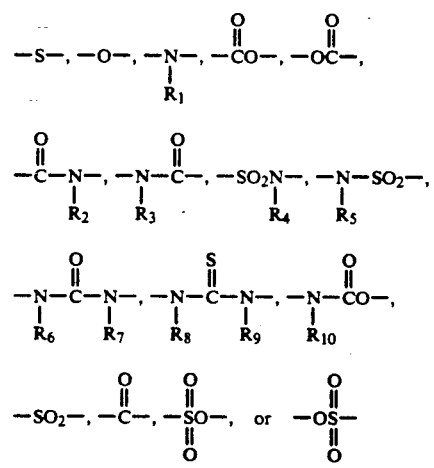

or a combination thereof with a straight chain or branched alkylene group wherein $R_1$, $R_2$, $R_3$, $R_4$, $R_5$, $R_6$, $R_7$, $R_8$, $R_9$ and $R_{10}$ each represents hydrogen, a substituted or unsubstituted alkyl group, a substituted or unsubstituted aryl group, a substituted or unsubstituted alkenyl group or a substituted or unsubstituted aralkyl group; $A_2$ represents a divalent linkage group selected from a straight chain or branched alkylene group, a straight chain or branched alkenylene group, a straight chain or branched aralkylene group or a straight chain or branched arylene group; B represents a substituted or unsubstituted amino group, an ammonium group, or a nitrogen-containing heterocyclic ring; m represents the integer 1, 2, or 3; and p represents 0 or the integer 1, wherein said nucleation accelerator of formula (Ia) is present in an amount of from 5 mg/m$^2$ to 500 mg/m$^2$ in said photographic material, and wherein said hydrazine derivative is present in an amount of from 1 mg/m$^2$ to 300 mg/m$^2$ in said photographic material.

2. A process as in claim 1, wherein said Y absorbing group is a nitrogen-containing heterocyclic group such that said nucleation accelerator is represented by formula

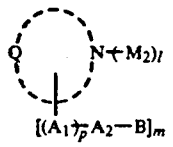

wherein Q represents an atomic group necessary for forming a 5- or 6-membered heterocyclic ring composed of members selected from carbon, nitrogen, oxygen and sulfur or the condensation product of said 5- or 6-membered ring with a carbon aromatic ring or a heteroaromatic ring; $M_2$ represents hydrogen, an alkali metal atom, an ammonium group or a group capable of being replaced with hydrogen or an alkali metal atom under alkali conditions; and l represents 0 or the integer 1.

3. A process as in claim 2, wherein said nitrogen-containing heterocyclic group comprises a substituted or unsubstituted indazole, benzimidazole, benzotriazole, benzoxazole, benzthiazole, imidazole, thiazole, oxazole, triazole, tetrazole, azaindene, pyrazole, indole, triazine, pyrimidine, pyridine or quinoline.

4. A process as in claim 2, wherein said $M_2$ releasing group is acetyl, cyanoethyl or methanesulfonylethyl.

5. A process as in claim 1, wherein said B nitrogen-containing heterocyclic ring is imidazolyl, pyridyl or thiazolyl.

6. A process as in claim 2, wherein said nucleation accelerator is represented by the formula

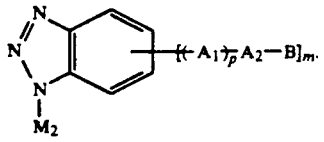

7. A process as in claim 2, wherein said nucleation accelerator is represented by the formula

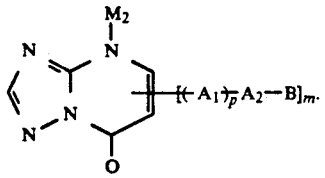

8. A process as in claim 2, wherein said nucleation accelerator is represented by the formula

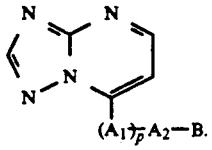

9. A process as in claim 2, wherein said nucleation accelerator is represented by the formula

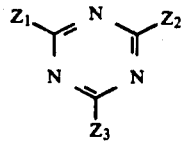

wherein $Z_1$, $Z_2$, and $Z_3$ each represents $(A_1)_pA_2$—B or a halogen atom, an alkoxy group having from 1 to 20 carbon atoms, a hydroxy group, a hydroxyamino group or a substituted or unsubstituted amino group provided that at least one of $Z_1$, $Z_2$, and $Z_3$ is $(A_1)_pA_2$—B.

10. A process as in claim 1, wherein said hydrazine derivative is represented by the formula $R_{21}$—NHNH—CHO wherein $R_{21}$ is an aliphatic group having from 1 to 30 carbon atoms or an aromatic group comprising a monocyclic or dicyclic aryl group, an unsaturated heterocyclic group or the condensation product of the unsaturated heterocyclic group with the monocyclic or dicyclic aryl group.

11. A process as in claim 1, wherein said developer contains sulfite ion at a concentration of at least 0.15 mol/liter.

* * * * *